US009879856B2

(12) United States Patent
Tsai

(10) Patent No.: US 9,879,856 B2
(45) Date of Patent: Jan. 30, 2018

(54) GAS COMBUSTOR

(71) Applicant: Wei-Ming Tsai, New Taipei (TW)

(72) Inventor: Wei-Ming Tsai, New Taipei (TW)

( * ) Notice: Subject to any disclaimer, the term of this patent is extended or adjusted under 35 U.S.C. 154(b) by 672 days.

(21) Appl. No.: 14/549,644

(22) Filed: Nov. 21, 2014

(65) Prior Publication Data

US 2016/0097530 A1 Apr. 7, 2016

(30) Foreign Application Priority Data

Oct. 6, 2014 (TW) ..... 103217788 U

(51) Int. Cl.

| | |
|---|---|
| ***F23D 14/28*** | (2006.01) |
| ***F23D 14/38*** | (2006.01) |
| ***F23D 14/20*** | (2006.01) |
| ***F23Q 3/00*** | (2006.01) |

(52) U.S. Cl.

CPC ..... *F23D 14/28* (2013.01); *F23D 14/20* (2013.01); *F23D 14/38* (2013.01); *F23Q 3/002* (2013.01); *F23N 2035/24* (2013.01)

(58) Field of Classification Search

CPC ..... F23D 14/28; F23D 14/38; F23N 2035/24
See application file for complete search history.

(56) References Cited

U.S. PATENT DOCUMENTS

| | | | | |
|---|---|---|---|---|
| 5,466,149 | A | 11/1995 | Tsai | |
| 5,564,919 | A | 10/1996 | Tsai | |
| 5,735,684 | A | 4/1998 | Tsai | |
| 5,816,794 | A | 10/1998 | Tsai | |
| 6,065,959 | A * | 5/2000 | Tsai | F23D 14/28 126/406 |
| 6,488,495 | B1 * | 12/2002 | Long | F23D 14/28 431/110 |

* cited by examiner

*Primary Examiner* — Jorge Pereiro
(74) *Attorney, Agent, or Firm* — Guice Patents PLLC

(57) ABSTRACT

The present invention provides a gas combustor which includes a gas container having a discharging nozzle, a fuel gas controlling device, and a piston disposed between the gas container and the fuel gas controlling device and capable of being reciprocally moved; through the pressure applied by a second spring provided in the fuel gas controlling device to the piston being greater than the pressure of a first spring and the fuel gas in the discharging nozzle and the pressure applied by the second spring to the piston being smaller than the pressure for vaporizing fuel in a vaporization chamber, the piston is enabled to be reciprocally and axially moved for opening or closing the discharging nozzle, thus the liquid gas can be effectively and fully vaporized and the combustion efficiency can be greatly enhanced.

14 Claims, 9 Drawing Sheets

GAS COMBUSTOR

BACKGROUND OF THE INVENTION

1. Field of the Invention

The present invention relates to a gas combustor, especially to a gas combustor capable of fully vaporizing liquid gas.

2. Description of Related Art

Fire is a must have element in our lives, with fire, we can cook food, can be provided with lighting, and the fire can also be used for combustion operations such as forging, soldering and welding. Take a canned gas for example, liquid gas is contained therein, the canned gas can be used for refilling a lighter or combined in a portable gas stove for lighting objects or cooking food, thereby providing convenience in use.

With the convenience provided by the canned gas, there are two types of gas combustors in the marketplace, the U.S. Pat. No. 5,466,149 (corresponding to the Taiwan Utility Patent No. 110192) and the U.S. Pat. No. 5,564,919 (corresponding to the Taiwan Utility Patent No. 112652) have disclosed a gas combustor, in which a connection nozzle at the bottom thereof is connected to a gas discharge valve of a canned gas, so liquid gas can be injected into a fuel storage tank, thereby enabling a gas discharge device installed in the gas combustor to be provided with the gas and a combustion device to be provided with fuel.

Another type of gas combustor is illustrated as following: the U.S. Pat. No. 5,735,684 (corresponding to the Taiwan Utility Patent No. 134495) and the U.S. Pat. No. 5,816,794 (corresponding to the Taiwan Utility Patent No. 122521) have disclosed a gas combustor, in which an engage device is installed in the gas combustor, after being connected with a canned gas available in the marketplace, the fuel in the canned gas is enabled to be supplied to the combustion device, thereby being able to be used for soldering or welding or other combustion operations.

In fact, when the second type of the above-mentioned gas combustor is used for soldering, welding or drying, the hand-held canned gas is often disposed upside down. At this moment, because the liquid gas is released with high pressure, the liquid gas may not have enough time for being fully vaporized, so some liquid gas would be directly ejected out from the flame nozzle, the unsufficient combustion may not only lower the combustion efficiency but also cause a possible accident. Moreover, on some occasion with lower temperature, the phase changing from liquid phase to gaseous phase happened inside the canned gas may not be complete due to the low temperature environment, so the gas combustor is not easy to be ignited.

As such, how to enable the gas combustor to effectively and fully vaporize the liquid gas for increasing the combustion efficiency shall be seriously concerned by the skilled people in the art.

SUMMARY OF THE INVENTION

One primary objective of the present invention is to provide a gas combustor, in which a reciprocally-moving piston is disposed between a gas container and a fuel gas controlling device, and the piston is provided with a pressure stabilizing function thereby allowing liquid gas to be effectively and fully vaporized so as to increase the combustion efficiency.

For achieving said objective, one technical solution provided by the present invention is to provide a gas combustor, which includes: a gas container, the bottom end thereof is provided with a filling nozzle and the top end thereof is formed with a connection part, and the connection part is axially connected to a discharging nozzle, the discharging nozzle includes a valve seat having the top end being axially formed with a valve hole, and the interior of the valve seat is provided with a valve pin capable of protruding out of the valve hole for opening or closing the valve hole, and a first spring enabling the valve pin to be axially and elastically retractable; a fuel gas controlling device, the bottom end thereof is formed with an accommodation chamber, the inner periphery of the accommodation chamber is formed with an engage part connected to the connection part, the top end of the accommodation chamber is axially formed with a sleeve hole, and the top end of the sleeve hole is axially connected to a fuel gas channel, the downstream end of the fuel gas channel is provided with a gas ejecting nozzle; wherein, the fuel gas channel is communicated with a rod hole, and the rod hole is further connected to a control rod capable of opening or closing the fuel gas channel; and a piston, which includes a piston disc sleeved in the accommodation chamber, the top surface of the piston disc is axially protruded with a sleeve column sleeved in the sleeve hole, and the piston disc and the sleeve column are axially formed with a penetrated hole allowing the fuel gas to pass, wherein the bottom end of the piston and the top surface of the connection part are formed with a vaporization chamber, and a second spring is disposed between the piston disc and the accommodation chamber; through the pressure applied by the second spring to the piston being greater than the pressure of the first spring and the fuel gas in the discharging nozzle and the pressure applied by the second spring to the piston being smaller than the pressure for vaporizing fuel in the vaporization chamber, the piston is enabled to be reciprocally and axially moved for opening or closing the discharging nozzle.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
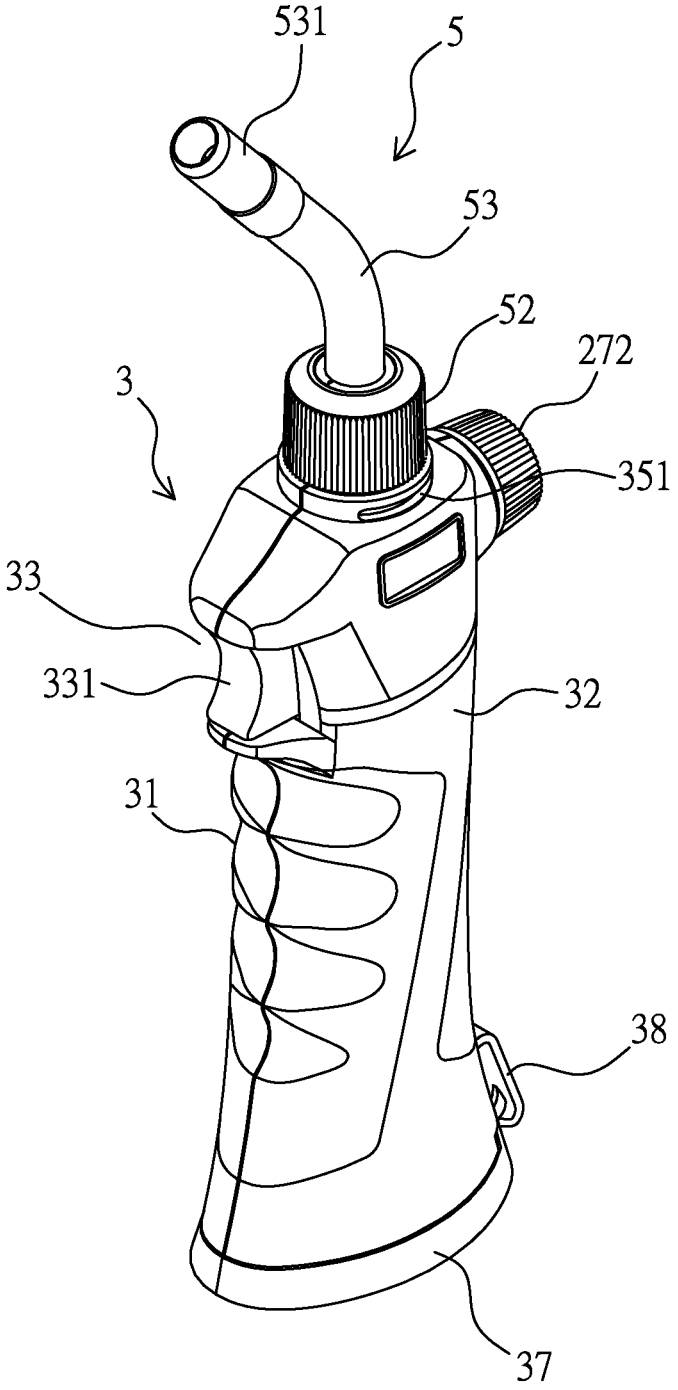
FIG. 1 is a perspective view illustrating the gas combustor according to the present invention.

Referring from FIG. 1 to FIG. 5, the present invention provides a gas combustor, which includes a gas container 1, a fuel gas controlling device 2, a housing 3, a piezoelectric device 4 and a combustion device 5.

The gas container 1 is provided with a function of being repeatedly filled and stored with liquid gas, for example as what has been disclosed in the Taiwan Patent Application NO. 103108440 applied on Mar. 11, 2014. As such, the top end and the bottom end of the gas container 1 formed as a metal cylinder are respectively provided with a filling nozzle 11 and a discharging nozzle 12; the filling nozzle 11 is connected to a discharging valve of a canned gas (not shown in figures), then high-pressure liquid gas is able to be filled and stored in the gas container 1. The top end of the gas container 1 is provided with a connection part 13 allowing the discharging nozzle 12 to be connected; in actual practice, the connection part 13 can be formed as a thread part thereby being able to be connected to the bottom end of the fuel gas controlling device 2.

Figure 4:
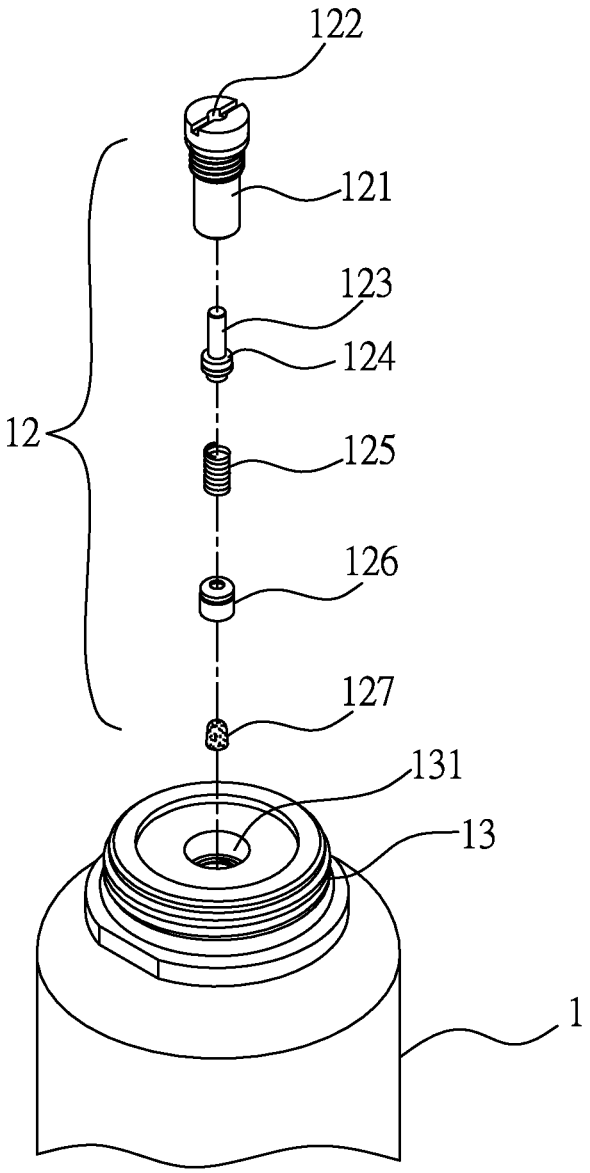
FIG. 4 is a perspective exploded view illustrating the discharging nozzle of the gas container according to the present invention.
Figure 5:
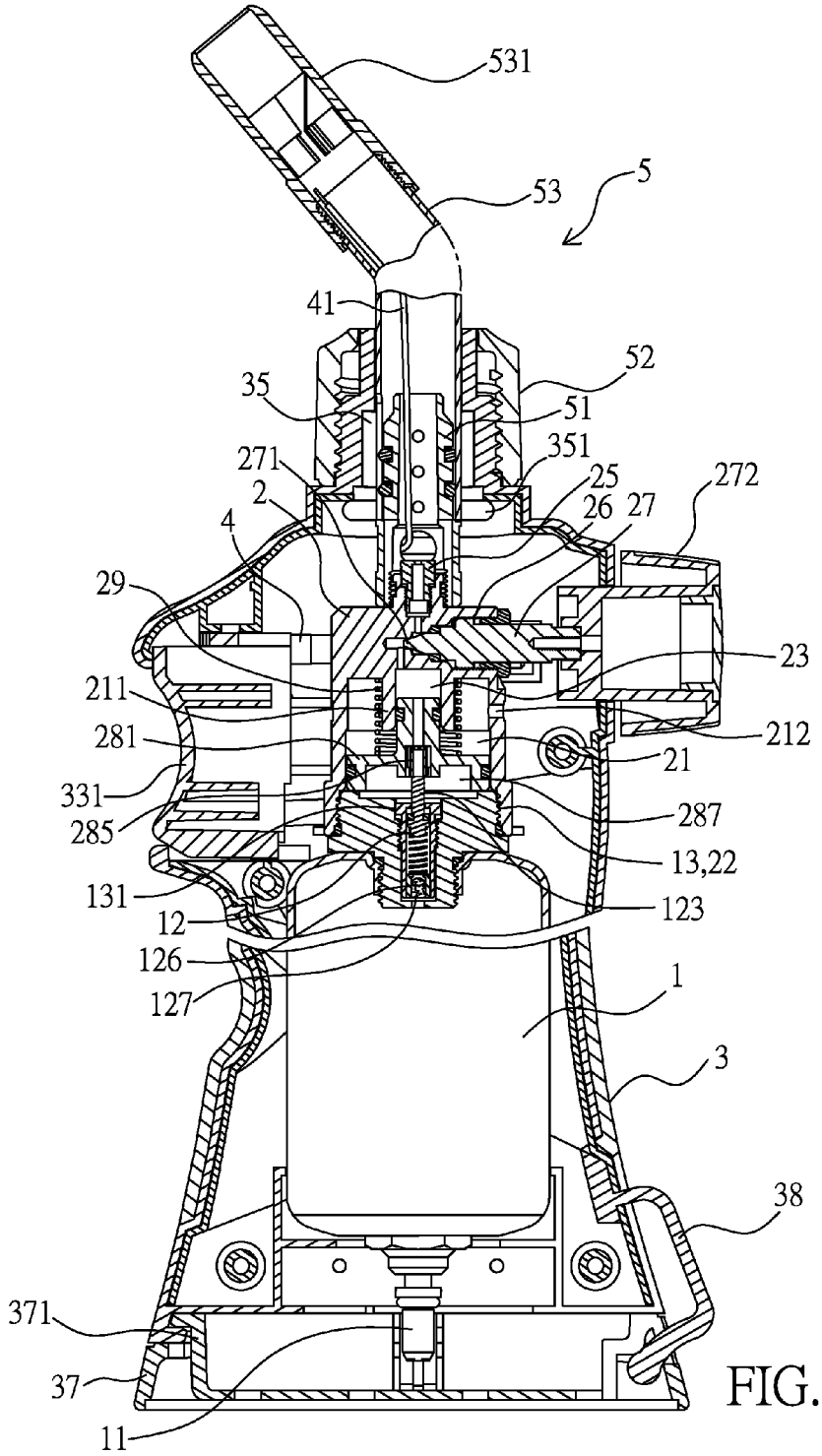
FIG. 5 is a cross sectional view illustrating the assembly of the gas combustor according to the present invention.
Figure 6:
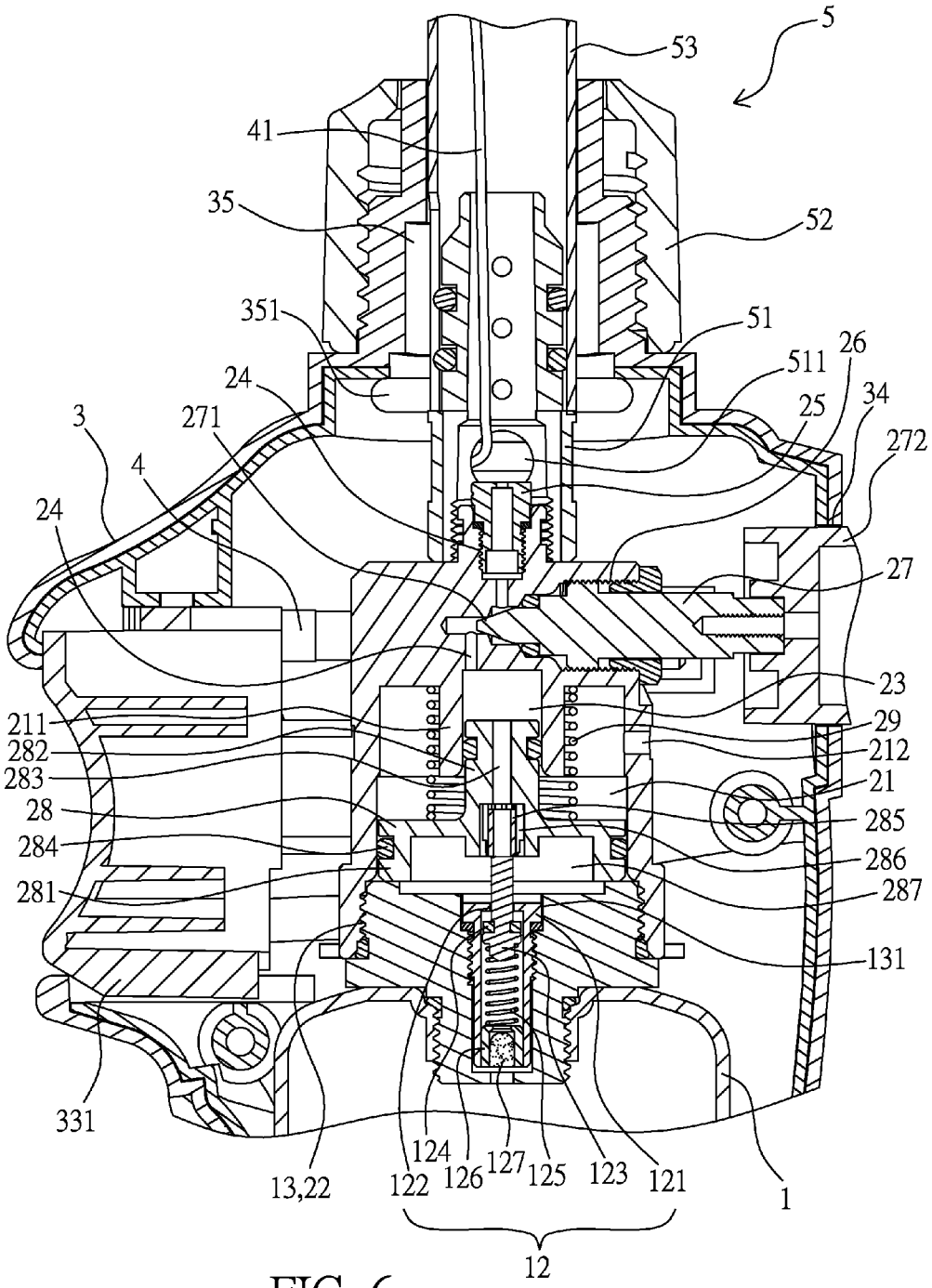
FIG. 6 is a partially enlarged cross sectional view illustrating the assembly of the gas container and the fuel gas controlling device according to the present invention.

Referring from FIG. 4 to FIG. 6, the discharging nozzle 12 is combined, e.g. screw-fitted, with a connection port 131 preformed on the connection part 13, and the discharging nozzle 12 includes a valve seat 121, the top end of the valve seat 121 is axially formed with a valve hole 122, and a stepped valve pin 123 is disposed in the valve hole 122, thereby allowing the upper portion of the valve pin 123 to be protruded out of the valve hole 122, and an anti-leaking ring 124 sleeved at the outer periphery of the valve pin 123 is served to constantly seal the valve hole 122 for forming an airtight effect.

In addition, the bottom end of the valve pin 123 is adjacent to one end of a first spring 125, and an inner cover 126 allowing gaseous and/or liquid gas to pass is combined, e.g. sleeved, at the bottom end of the valve hole 122, the other end of the first spring 125 is adjacent to the top end of the inner cover 126, thereby enabling the upper portion of the valve pin 123 to be axially and elastically retractable in the vale hole 122 for controlling the supply of gaseous and/or liquid gas.

Moreover, the interior of the inner cover 126 is provided with a filtering material 127 for filtering debris, e.g. iron rusts, inside the gas container 1. Wherein, the filtering material 127 is preferably to be a sintered member with micro pores formed through powder metallurgy or a sponge cushion.

As shown in FIG. 2, FIG. 3, FIG. 5 and FIG. 6, the fuel gas controlling device 2 is formed as a metal tubular body, and the bottom end thereof is formed with an accommodation chamber 21, the inner periphery of the accommodation chamber 21 is formed with an engage part 22, e.g. a thread part, for being integrally connected to the connection part 13, thereby allowing the fuel gas controlling device 2 to be fastened on the gas container 1. The top end of the accommodation chamber 21 is axially formed with a sleeve hole 23, and the top end of the sleeve hole 23 is axially connected to a fuel gas channel 24, the downstream end of the fuel gas channel 24, i.e. an opening at the top end of the fuel gas controlling device 2, is provided with a gas ejecting nozzle 25, thereby allowing the fuel gas which has already been fully vaporized to be ejected from the gas ejecting nozzle 25.

The fuel gas channel 24 is radially communicated with a stepped rod hole 26, and the rod hole 26 is further connected, e.g. screw-fitted, to a control rod 27, the outer side of the control rod 27 is further connected to a rotary button 272 at a rear opening 34 of the housing 3. As such, when the rotary button 272 is rotated, the control rod 27 is able to be synchronously driven to move towards inward or outward in the rod hole 26 for enabling a conical rod tip 271 at the inner end to open or close the fuel gas channel 24 so as to control the supply of fuel gas.

The technical feature of the fuel gas controlling device 2 is that the interior of the accommodation chamber 21 is sleeved with a stepped piston 28, the piston 28 includes a piston disc 281 sleeved in the accommodation chamber 21, the top surface of the piston disc 281 is axially protruded with a sleeve column 282 sleeved in the sleeve hole 23, and the piston disc 281 and the sleeve column 282 are axially formed with a penetrated hole 283 allowing the fuel gas to pass. Wherein, the piston disc 281 and the sleeve column 282 are respectively and radially sleeved with a sealing ring 284, thereby allowing the accommodation chamber 21 and the sleeve hole 23 to be in an airtight status.

For providing a reciprocally-moving dynamic energy to the piston 28, the top surface of the piston disc 281 is provided with a second spring 29 at the outer side of the sleeve column 282, and two ends of the second spring 29 are respectively abutted against the piston disc 281 and the top wall of the accommodation chamber 21. In actual practice, the sleeve hole 23 is formed in an extended pipe 211 axially protruded from the top wall of the accommodation chamber 21, the outer end of the extended pipe 211 is further sleeved with the second spring 29, and the bottom end of the extended pipe 211 and the top end of the connection part 13 are respectively served as the limitations to the upward/downward movement of the piston 28.

Furthermore, the top end of the accommodation chamber 21 is formed with a through hole 212 communicated with the exterior, thereby preventing air from entering or being discharged from the accommodation chamber 21 via the through hole 212 while the piston 28 performing the reciprocal upward/downward movement.

Furthermore, the penetrated hole 283 is also formed in a stepped status, and the upstream end thereof is sleeved with a gear-like abutting member 285, when the abutting member 285 is not in an operating status and the piston 28 is downwardly moved to a bottom dead center, the abutting member 285 and the piston 28 are both served to press the valve pin 123 of the discharging nozzle 12, thereby enabling the discharging nozzle 12 to be in a gas supplying status.

Furthermore, the bottom end of the piston 28 and the top surface of the connection part 13 are formed with a vaporization chamber 287, thereby allowing the gaseous and/or liquid gas to be filled from the discharging nozzle 12 into the vaporization chamber 287 and fully vaporized in the vaporization chamber 287 so as to enter the penetrated hole 283 from a plurality of slits 286 formed at the outer periphery of the abutting member 285, thus the fuel gas is able to pass the sleeve hole 23, the fuel gas channel 24 for being ejected out from the gas ejecting nozzle 25.

As shown in FIG. 5 and FIG. 6, when the control rod 27 is served to close the fuel gas channel 24, the elastic force of the second spring 29 is greater than the elastic force of the first spring 125 of the discharging nozzle 12, so the second spring 29 is in an energy releasing (stretched) status, and the piston 28 is downwardly moved to the bottom dead center for pressing the valve pin 123 of the discharging nozzle 12, the discharging nozzle 12 is in a gas supplying status, thereby allowing the gaseous and/or liquid gas to be filled in the vaporization chamber 287, so the vaporizing operation is able to be processed, and the fully-vaporized fuel gas is enabled to enter the penetrated hole 283 through the plural slits 286 formed at the outer periphery of the abutting member 285, then pass the sleeve hole 23 and the fuel gas channel 24 and stopped by the rod tip 271 of the control rod 27.

Figure 7:
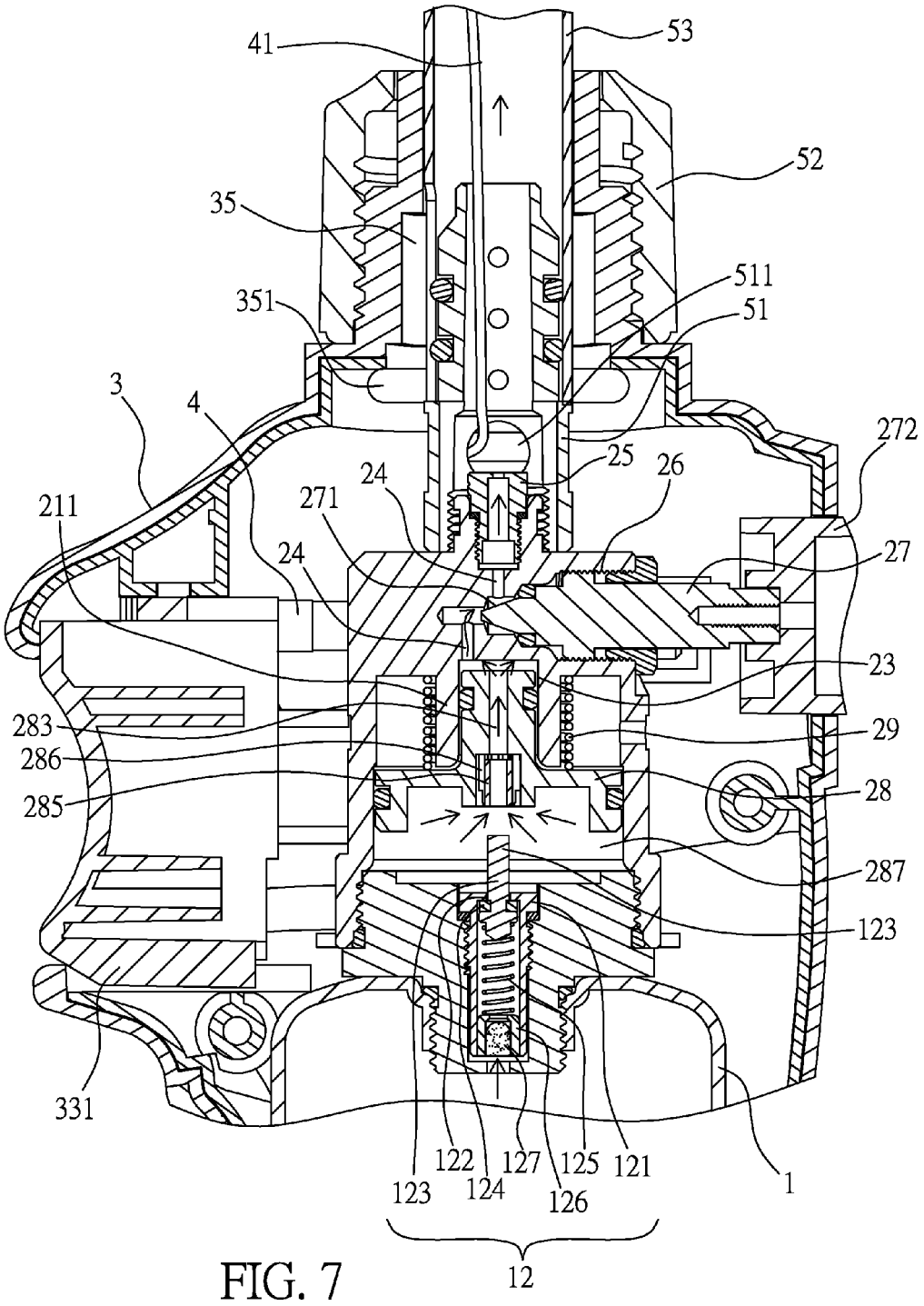
FIG. 7 and FIG. 8 are partially enlarged cross sectional views illustrating the operation of the piston disposed between the gas container and the fuel gas controlling device according to the present invention.

As shown in FIG. 7, when the rotary button 272 is rotated, the control rod 27 is driven to rotate in the rod hole 26 for generating a radial outward displacement, so the rod tip 271 is enabled to open the fuel gas channel 24; at this moment, the high-pressure gaseous and/or liquid gas inside the gas container 1 is able to instantly pass the discharging nozzle 12 and enter the vaporization chamber 287, because the diameter of the gas ejecting nozzle 25 is relatively smaller, the excessive fuel gas or the liquid gas which has not yet been fully vaporized is able to be rapidly filled and remained in the vaporization chamber 287, thereby causing the pressure inside the vaporization chamber 287 to be greater than the elastic force of the second spring 29, so the piston 28 is upwardly moved and the second spring 29 compressed (being in an energy storing status); the valve pin 123 of the discharging nozzle 12 is no longer pressed by the abutting member 285, so with the stretch effect provided by the first spring 125, the discharging nozzle 12 is closed for stopping the supply of gaseous and/or liquid gas. The liquid gas in the vaporization chamber 287 is then vaporized, so the fully-vaporized fuel gas is able to enter the penetrated hole 283 through the plural slits 286 formed at the outer periphery of the abutting member 285, and pass the sleeve hole 23 and the fuel gas channel 24 for being ejected out from the gas ejecting nozzle 25.

Figure 8:
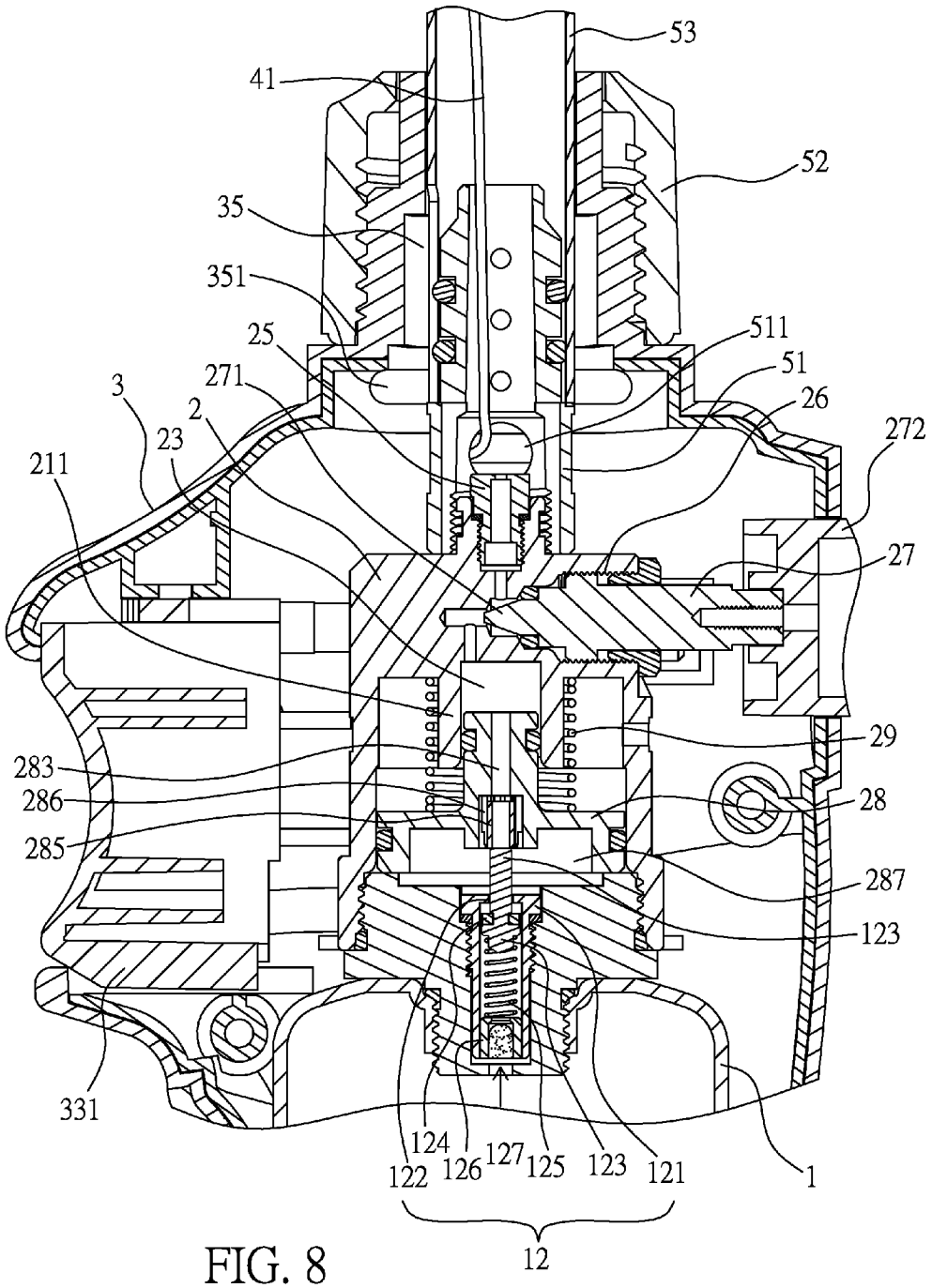

When the fuel gas in the vaporization chamber 287 is gradually ejected by the gas ejecting nozzle 25, the pressure inside the vaporization chamber 287 is gradually reduced, at this moment the second spring 29 is stretched for pushing the piston 28 to be downwardly moved, and the abutting member 285 is in contact with and presses the valve pin 123 of the discharging nozzle 12, so the valve pin 123 is downwardly moved and the first spring 125 is compressed for forming the gaseous and/or liquid gas supplying status as shown in FIG. 8.

In fact, because the gaseous and/or liquid gas is able to rapidly flow between the discharging nozzle 12 of the gas container 1 and the piston 28 of the fuel gas controlling device 2, the piston 28 and the valve pin 123 are also able to be rapidly and reciprocally moved, so the liquid gas is enabled to be fully vaporized to fuel gas and an effect of maintaining constant pressure is achieved As such, when the pressure applied by the second spring 29 to the piston 28 is greater than the pressure of the first spring 125 and the fuel (gas) in the discharging nozzle 12, and the pressure applied by the second spring 29 to the piston 28 is smaller than the pressure for vaporizing fuel in the vaporization chamber 287, the piston 28 is enabled to be reciprocally moved relative to the discharging nozzle 12 for forming the opening or closing effect.

The housing 3 is composed of a left shell 31 and a right shell 32 being engaged with each other, and used for enclosing and fastening the gas container 1 and the fuel gas controlling device 2 which have already been combined as one piece. The assembly of the gas combustor is as shown in FIG. 1, wherein the front opening 33 and the rear opening 34 of the housing 3 are respectively provided by a press button 331 and the rotary button 272, and a top opening 35 at the top end of the housing 1 is connected to the combustion device 5, and a bottom opening 36 is provided with a bottom cover 37 for opening or closing the bottom opening 36 of the housing 3.

A connection strip 38 made of an elastic polymer material is connected between the bottom cover 37 and the housing 3, thereby preventing the bottom cover 37 from being released from the housing 3. Referring to FIG. 2 and FIG. 9*a* to FIG. 9*c*, for allowing the bottom cover 37 and the bottom opening 36 to be combined or separated, the top surface of the bottom cover 37 is formed with an annular flange 371, the periphery defined on the top surface of the flange 371 is radially formed with a plurality of buckle sheets 372; and the interior of the bottom opening 36 is formed with an annular stop sheet 361 and a plurality of buckle slots 362 corresponding to the annular flange 371 and the plural buckle sheets 372.

Figure 9A:
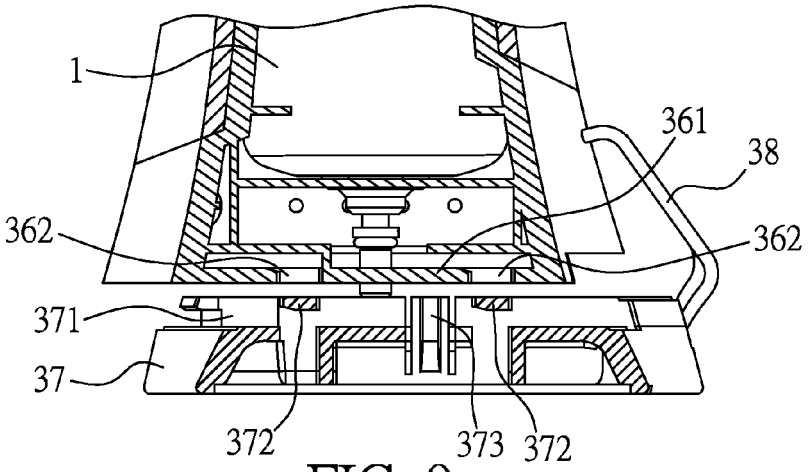
FIG. 9*a* to FIG. 9*c* are cross sectional views illustrating the process of the housing being combined with the bottom cover according to the present invention.
Figure 9B:
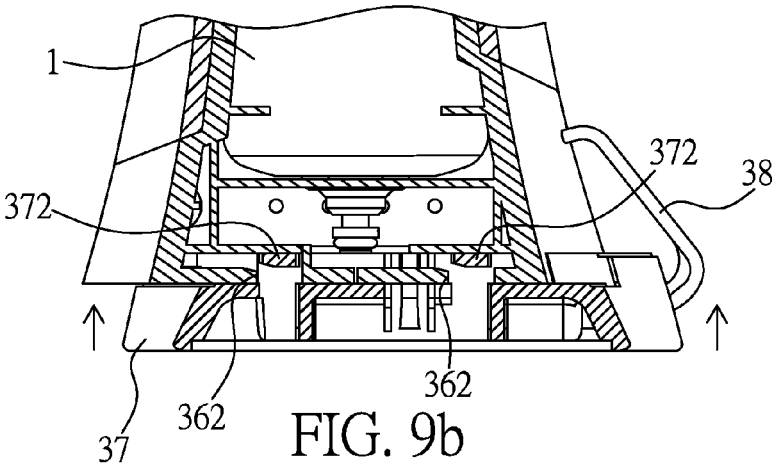
Figure 9C:
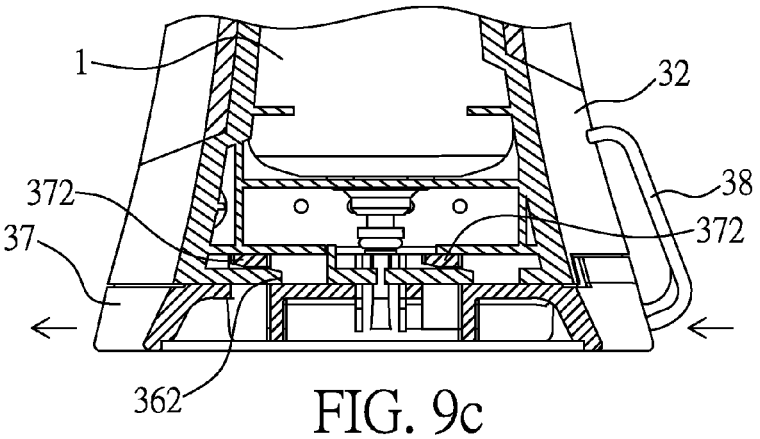

As such, when the bottom cover 37 is desired to be combined and fastened in the bottom opening 36, each of the buckle sheets 372 of the annular flange 371 is aimed at each of the buckle slots 362 of the annular stop sheet 361 (as shown in FIG. 9*a*), then the bottom cover 37 is upwardly moved for allowing each of the buckle sheets 372 to be received in each of the buckle slots 362 (as shown in FIG. 9*b*), and the bottom cover 37 is radially and forwardly moved for allowing each of the buckle sheets 372 and each of the buckle slots 362 to be formed in a staggering and locking status (as shown in FIG. 9*c*), so the bottom cover 37 is enabled to be fastened in the bottom opening 36 for closing the bottom opening 36. If the bottom cover 37 is reversely operated, the bottom cover 37 is able to be released from the bottom opening 36, and the bottom cover 37 is enabled to be disposed at one side of the bottom opening 36 via the connection strip 38 thereby avoiding loosening or missing. At this moment, a user can fill gas into the gas container 1 through the filling nozzle 11.

In addition, the annular flange 371 is radially formed with a pair of elastic positioning tenons 373 which are corresponding to each other, and the annular stop sheet 361 is respectively and axially formed with a pair of first positioning holes 363 and a pair of second positioning holes 364 corresponding to the closing and the opening locations. As such, when the bottom cover 37 is locked for being in a closed status, the pair of positioning tenons 373 are buckled in the pair of first positioning holes 363; when the bottom cover 37 is unlocked for being in an opened status, the pair of positioning tenons 373 are buckled in the pair of second positioning holes 364.

The front opening 33 of the housing 3 is formed with a fasten slot 332 allowing the piezoelectric device 4 to be accommodated and positioned, thereby allowing the front end of the piezoelectric device 4 to be adjacent to the press button 331 in the front opening 33. Wherein, the piezoelectric device 4 is provided with an electric wire 41 capable of penetrating into the combustion device.

Figure 2:
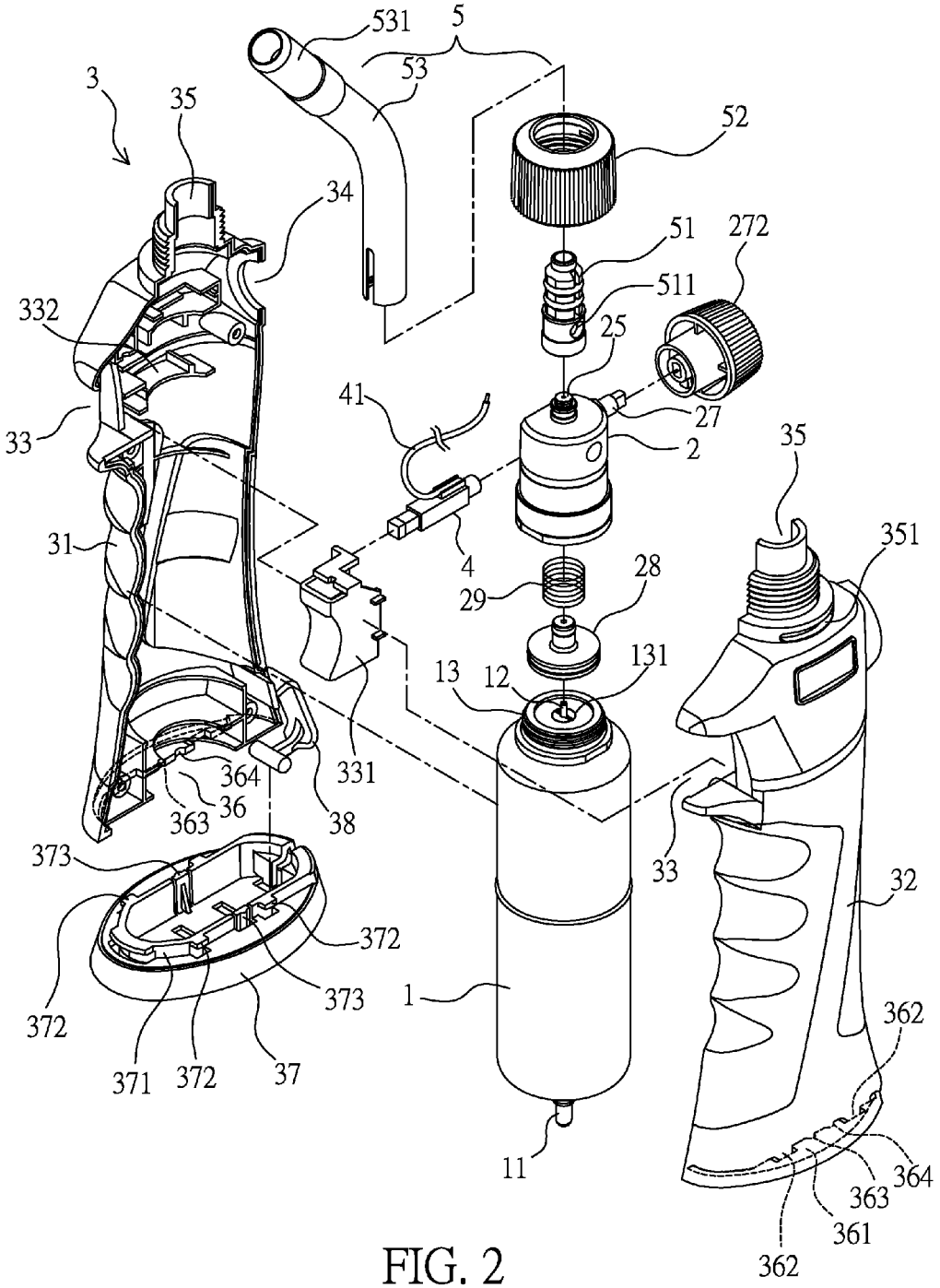
FIG. 2 is a perspective exploded view illustrating major components of the gas combustor according to the present invention.
Figure 3:
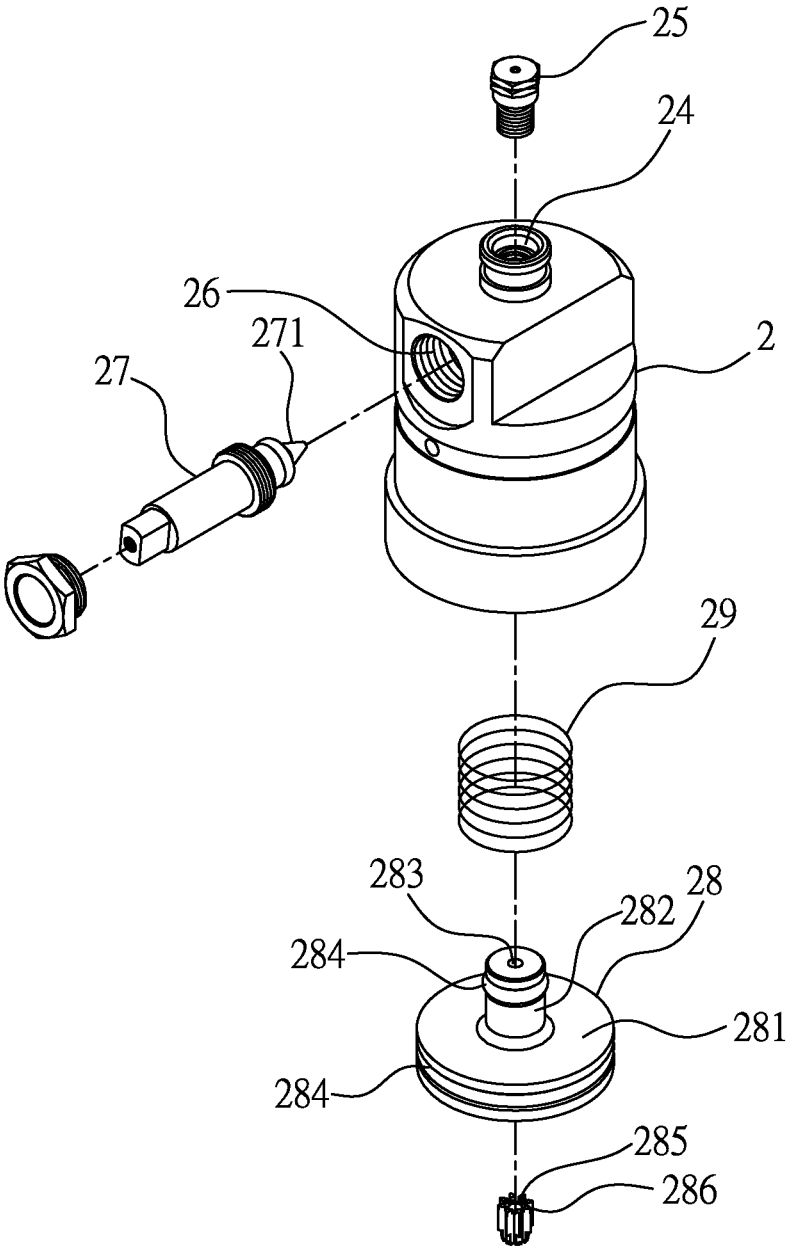
FIG. 3 is a perspective exploded view illustrating the fuel gas controlling device according to the present invention.

As shown in FIG. 1, FIG. 2 and FIG. 5, the combustion device 5 includes a mix pipe 51, a strain ring 52 and a combustion pipe 53. The mix pipe 51 is sleeved in the top opening 35 of the housing 3, the bottom end thereof is served to enclose the gas ejecting nozzle 25, and the lower portion of the mix pipe 51 is formed with at least a ventilation hole 511 for introducing air from air guiding slots 351 preformed at two sides defined in the top opening 35 of the housing 3, so the introduced air is able to enter the mix pipe 51 through the ventilation hole 511 for being mixed with the fuel gas ejected by the gas ejecting nozzle 25 thereby forming a mixed fuel gas.

The strain ring 25 is combined, e.g. screw-fitted, in the top opening 35, and the combustion pipe 53 is able to pass the strain ring 25 and sleeved with the mix pipe 51, the downstream end of the combustion pipe 53 is installed with a gas guiding set 531 capable of guiding the flowing direction of the mixed fuel gas. Wherein, the gas guiding set 531 is e.g. but not limited to a cross-shaped rotary member, so when the mixed fuel gas passes the cross-shaped rotary member, a vortex-like flame can be generated thereby enhancing the combustion effect. The electric wire 41 of the piezoelectric device 4 is enabled to enter the mix pipe 51 through the ventilation hole 511 and further extended to the ambience of the gas guiding set 531.

As such, when the press button 331 is pressed, the piezoelectric device 4 is synchronously compressed, the generated static electricity is transferred via the electric wire 41, so a static spark is generated between the electric wire 41 and the gas guiding set 531, thereby enabling the mixed fuel gas passing the gas guiding set 531 to be ignited, and the flame is ejected out from a pipe opening 532 of the combustion pipe 53.

In actual practice, referring to FIG. 1, FIG. 2 and FIG. 5, the user holds the housing 3 with one hand, and uses the other hand to rotate the rotary button 272, so the control rod 27 is enabled to open the fuel gas channel 24 of the fuel gas controlling device 2, the fully-vaporized fuel gas is able to be ejected out from the gas ejecting nozzle 25 for entering the mix pipe 51 so as to be mixed with the air introduced through the ventilation hole 511 for forming as the mixed fuel gas, and the mixed fuel gas is able to pass the gas guiding set 531 in the combustion pipe 53. Then, the user uses his/her index finger to press the press button 331 in the front opening 33 of the housing 3, so the piezoelectric device 4 is compressed while the press button 331 is being inwardly retracted, the generated static electricity is transferred via the electric wire 41, and a static spark is generated between the electric wire 41 and the gas guiding set 531, so the mixed fuel gas passing the gas guiding set 531 is able to be ignited and the flame is ejected out from the pipe opening 532 of the combustion pipe 53 for processing the combustion operation.

At this moment, between the gas container 1 and the fuel gas controlling device 2, through the pressure applied by the second spring 29 to the piston 28 being greater than the pressure of the first spring 125 and the fuel gas in the discharging nozzle 12, and the pressure applied by the second spring 29 to the piston 28 being smaller than the pressure for vaporizing fuel in the vaporization chamber 287, the piston 28 is enabled to be reciprocally moved relative to the discharging nozzle 12 for forming the opening or closing status, so after the pressure stabilizing effect is taken place, the fully-vaporized fuel gas is able to enter the fuel gas channel 24 and ejected out from the gas ejecting nozzle 25.

When the combustion operation is desired to be stopped, the rotary button 27 is reversely rotated for enabling the rod tip 271 of the control rod 27 to close the fuel gas channel 24, so the fuel gas supply is terminated and the flame is put out.

Based on what has been disclosed above, advantages achieved by the present invention are as followings: the reciprocally-moving piston is disposed between the gas container and the fuel gas controlling device, and through the pressure applied by the second spring to the piston being greater than the pressure of the first spring and the fuel gas in the discharging nozzle and the pressure applied by the second spring to the piston being smaller than the pressure for vaporizing fuel in the vaporization chamber, the piston is enabled to be reciprocally and axially moved for opening or closing the discharging nozzle, thus the liquid gas can be effectively and fully vaporized and the combustion efficiency can be greatly enhanced; accordingly, the gas combustor provided by the present invention is novel and more practice in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor, including:

a gas container, the bottom end thereof being provided with a filling nozzle and the top end thereof being formed with a connection part, and said connection part being axially connected to a discharging nozzle, said discharging nozzle including a valve seat having the top end being axially formed with a valve hole, and the interior of said valve seat being provided with a valve pin capable of protruding out of said valve hole for opening or closing said valve hole, and a first spring enabling said valve pin to be axially and elastically retractable;

a fuel gas controlling device, the bottom end thereof being formed with an accommodation chamber, the inner periphery of said accommodation chamber being formed with an engage part connected to said connection part, the top end of said accommodation chamber being axially formed with a sleeve hole, and the top end of said sleeve hole being axially connected to a fuel gas channel, the downstream end of said fuel gas channel being provided with a gas ejecting nozzle; wherein, said fuel gas channel being communicated with a rod hole, and said rod hole being further connected to a control rod capable of opening or closing said fuel gas channel; and a piston, including a piston disc sleeved in said accommodation chamber, the top surface of said piston disc being axially protruded with a sleeve column sleeved in said sleeve hole, and said piston disc and said sleeve column being axially formed with a penetrated hole allowing fuel gas to pass, wherein the bottom end of said piston and the top surface of said connection part being formed with a vaporization chamber, and a second spring being disposed between said piston disc and said accommodation chamber;

through the pressure applied by said second spring to said piston being greater than the pressure of said first spring and said fuel gas in said discharging nozzle and the pressure applied by said second spring to said piston being smaller than the pressure for vaporizing fuel in said vaporization chamber, said piston being enabled to be reciprocally and axially moved for opening or closing said discharging nozzle;

wherein the bottom end of said valve hole of said valve seat is further provided with an inner cover allowing gaseous and/or liquid gas to pass, and two ends of said first spring are respectively adjacent to said valve pin and said inner cover.

2. The gas combustor as claimed in claim 1, wherein the interior of said inner cover is provided with a filtering material.

3. The gas combustor as claimed in claim 2, wherein said filtering material is a sintered member with micro pores formed through powder metallurgy or a sponge cushion.

4. The gas combustor as claimed in claim 1, wherein said piston disc and said sleeve column are respectively and radially sleeved with a sealing ring.

5. The gas combustor as claimed in claim 1, wherein said sleeve hole is formed in an extended pipe axially protruded from the top wall of said accommodation chamber, the outer end of said extended pipe is further sleeved with said second spring, and the bottom end of said extended pipe and the top end of said connection part are respectively served as the limitations to the upward/downward movement of said piston.

6. The gas combustor as claimed in claim 1, wherein the top end of said accommodation chamber is formed with a through hole allowing air to pass.

7. The gas combustor as claimed in claim 1, wherein the upstream end of said penetrated hole is sleeved with a gear-like abutting member capable of pressing said discharging nozzle, and the outer periphery of said abutting member is formed with a plurality of slits.

8. The gas combustor as claimed in claim 1, further including a housing for enclosing and fastening said gas container and said fuel gas controlling device, said housing is composed of a left shell and a right shell being engaged with each other, a front opening and a rear opening thereof are respectively provided by a press button and a rotary button connected to said control rod, and a top opening and a bottom opening at the top end and the bottom end of said housing are respectively connected to a combustion device and a bottom cover capable of opening or closing said bottom opening.

9. The gas combustor as claimed in claim 8, wherein a connection strip made of an elastic polymer material is connected between said bottom opening and said bottom cover.

10. The gas combustor as claimed in claim 9, wherein the top surface of said bottom cover is formed with an annular flange, and the periphery defined on the top surface of said flange is radially formed with a plurality of buckle sheets; the interior of said bottom opening is formed with an annular stop sheet and a plurality of buckle slots corresponding to said annular flange and said plural buckle sheets; when said buckle sheets are aimed at and received in said buckle slots, said bottom cover is radially moved for allowing said buckle sheets and said buckle slots to be formed in a staggering and locking status, so said bottom cover is fastened in said bottom opening.

11. The gas combustor as claimed in claim 10, wherein said annular flange is radially formed with a pair of elastic positioning tenons which are corresponding to each other, and said annular stop sheet is respectively and axially formed with a pair of first positioning holes and a pair of second positioning holes corresponding to the closing location and the opening location; when said bottom cover is locked for being in a closed status, said pair of positioning tenons are buckled in said pair of first positioning holes, when said bottom cover is unlocked for being in an opened status, said pair of positioning tenons are buckled in said pair of second positioning holes.

12. The gas combustor as claimed in claim 8, wherein said front opening is formed with a fasten slot allowing a piezoelectric device to be accommodated and positioned, thereby allowing the front end of said piezoelectric device to be adjacent to said press button; wherein said piezoelectric device is provided with an electric wire capable of penetrating into said combustion device.

13. The gas combustor as claimed in claim 8, wherein said combustion device includes a mix pipe, a strain ring and a combustion pipe; said mix pipe is sleeved in said top opening, the bottom end thereof is served to enclose said gas ejecting nozzle, and the lower portion of said mix pipe is formed with at least a ventilation hole for introducing air from air guiding slots preformed at two sides defined in said top opening, so the introduced air is able to enter said mix pipe through said ventilation hole for being mixed with said fuel gas ejected by said gas ejecting nozzle thereby forming a mixed fuel gas; said strain ring is combined in said top opening, and said combustion pipe is able to pass said strain ring and sleeved with said mix pipe.

14. The gas combustor as claimed in claim 13, wherein the downstream end of said combustion pipe is installed with a gas guiding set capable of guiding the flowing direction of said mixed fuel gas.

* * * * *